United States Patent [19]

Wellman et al.

[11] Patent Number: 4,875,683

[45] Date of Patent: Oct. 24, 1989

[54] GOLF CLUB SWING IMPROVEMENT APPARATUS

[76] Inventors: Edward F. Wellman, 3920 Ellsworth Ave.; Francis J. Michaels, 220 Vivian Dr., both of, Munhall, Pa. 15120

[21] Appl. No.: 217,634

[22] Filed: Jul. 12, 1988

[51] Int. Cl.[4] ..... A63B 69/36; A43B 5/00

[52] U.S. Cl. ..... 273/187 B; 36/127; 36/132; 273/26 C

[58] Field of Search ..... 36/127, 132, 81; 273/32 C, 188 A, 187 B, 26 C; 128/581

[56] References Cited

U.S. PATENT DOCUMENTS

| | | | |
|---|---|---|---|
| 2,847,769 | 8/1958 | Schlesinger | 273/32 C |
| 3,218,734 | 11/1965 | O'Brien | 273/32 C |
| 4,167,071 | 9/1979 | Koransky | 273/32 C |
| 4,407,079 | 10/1983 | Chiroff | 36/127 |
| 4,754,561 | 7/1988 | Dufour | 36/127 |

*Primary Examiner*—George J. Marlo

*Attorney, Agent, or Firm*—William A. Behare

[57] ABSTRACT

A member having the general shape of a person's foot includes a thickened outer forward portion. The member is adapted to be inserted into the person's shoe for elevating the outer forward portion only of one foot of the person while swinging an object such as a golf club, ball bat or ax.

6 Claims, 2 Drawing Sheets

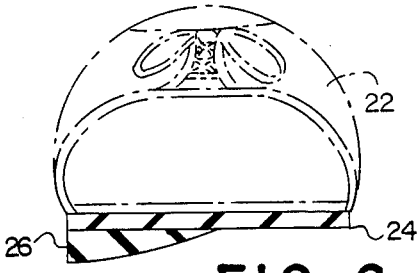
FIG. 6
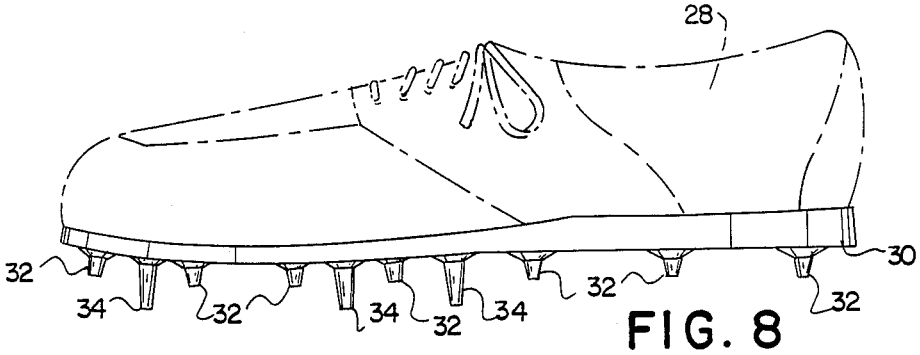
FIG. 8
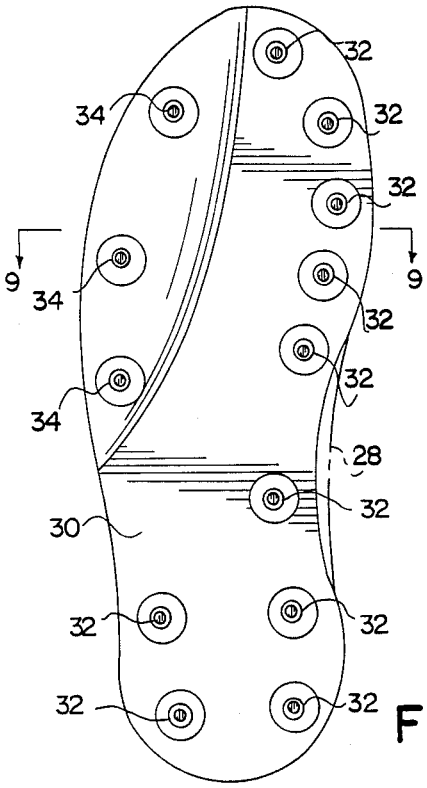
FIG. 7
FIG. 9
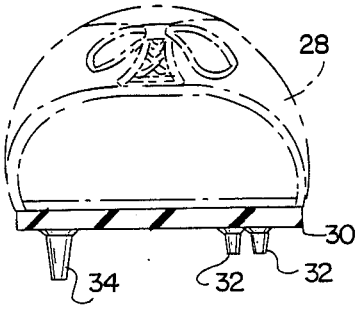

GOLF CLUB SWING IMPROVEMENT APPARATUS

BACKGROUND OF THE INVENTION

1. Field of the Invention

This invention pertains to apparatus which improves the manner in which a person swings an object such as a golf club, ball bat or ax and, more particularly, to apparatus which adjusts the positioning of one foot of the person during the swing of the object.

2. Description of the Prior Art

The game of golf is a game of skill which requires a combination of both good equipment and physical ability if a golfer is to be competitive. Most golfers strive to continually improve their golf game thereby reducing their average score as much as possible.

One important way for golfers to reduce their score is by increasing the distance that the golf ball travels on the first stroke of each hole. Ideally, the first stroke, of each hole, should carry the ball all the way from the tee to the green and, preferably, directly into the hole. However, in many cases the distance from the tee to the green is so great that the ball lands short of the green thereby requiring additional strokes which add to the golfer's score.

It is well known among most golfers that the physical stance that a golfer takes when swinging the gold club can affect the distance that the ball travels. It is well known that, during the proper swing of a golf club, the golfer's body weight should be shifted primarily by the application of force to the upper body of the person through one of the golfer's legs. If a golfer is right handed and, thereby, swings the golf club from right to left, it is, primarily, the golfer's right leg which is used for such weight shifting. Likewise, the left leg is used by a left-handed golfer. For purposes of clarity, the following discussion will be based on the swinging of an object by a right-handed person, although the principles are equally applicable to a left-handed person as well.

It has been found that by intentionally applying force to the right hip and upper body through the right leg, better shifting of body weight occurs resulting in a better gold club swing. Two important factors contribute to a better golf club swing.

1. At the address of the ball, a golfer's weight should be away from the toes of the feet and, preferably, rearward to the heels.

2. During the backswing of the golf club, the golfer's body weight should then be transferred to be positioned on the inside of the right foot so that, during the downswing, the golfer may apply force from the right foot, through the right leg and to the upper body. The initial distribution of body weight and transfer of body weight on the swing are two of the most important factors in hitting a powerful long distance shot.

Some golfers place a golf ball under the right side of their right foot which results in both better achievement of the above recited two factors and increased concentration on their golf swing. Such a technique is not practical during an actual golf match, however.

First, the use of an external device which is not an integral part of the golfer's equipment is not permitted under standard rules of golf. Second, the round surface of the ball may cause the golfer's foot to roll off the ball during a critical portion of the golf club swing thereby actually decreasing the accuracy of the swing and shortening the distance that the golf ball will travel.

Third, it is inconvenient for a golfer to position a golf ball under a foot before each stroke and then remove the ball afterwards.

It has, also, been determined that a more powerful baseball and softball bat swing occurs when the right leg of a right handed, or right-to-left swinging batter, applies force to the hip and upper body during the swing of a bat. Such a swing translates into a faster moving bat which, in turn, strikes a pitched ball with greater force thereby causing it to travel farther than when no such force is applied. As with golf, this may be achieved when the batter's initial stance and body weight shift occurs in accordance with the above recited two factors.

Batter's occasionally dig a small hole in the earth below their right foot which results in a somewhat concave indentation. The indentation allows the batter to position the right foot so that the right side of the right foot is elevated above the left side of the right foot thereby allowing the right leg to apply more force to the right hip and upper body. This is not practical for several reasons.

First, it is not always possible to dig an indentation, for example, when playing on an artificial surface or dry earth. Second, the degree to which the right side of the right foot will be elevated above the left side of the right foot will, in most cases, vary each time a new indentation is dug due to the makeshift method of digging the indention.

It has also been determined that a better and more forceful swing of non-sports related objects, such as an ax, is possible if the right side of the right foot of the person swinging the object is elevated above the left side of the right foot since more force may be applied to the upper body of the person swinging the bat.

Several devices have been proposed for elevating a portion of one or both of a person's foot during the swing of an object, such as a golf club. None of the proposed devices, however, provides the same adjustment of foot position as the claimed invention.

U.S. Pat. No. 2,078,626 discloses a lateral shoe heel extension which allows the left side of the user's right foot to be pivoted above the right side of the foot. U.S. Pat. No. 2,855,704 discloses shoes for golfers which incorporate heels which alter the angle that the rear or heel portion of the user's foot assumes with respect to the surface on which the person is standing.

U.S. Pat. No. 2,959,873 discloses golf shoes with apparatus to avoid vertical lift and lateral shift. These shoes adjust the position that the heels of a user assume with respect to the surface upon which the person is standing.

U.S. Pat. No. 2,959,874 discloses wedge-shaped heels which are incorporated on each of a pair of shoes. The heels cause the heel portion of both feet of the user to be tilted.

U.S. Pat. No. 3,789,523 discloses a golf shoe which includes a wedge-shaped sole and heel. This shoe causes the entire outer side of a user's foot to be elevated above the inner side. A plurality of varying length spikes counteracts that adjustment when a person is standing or walking on a surface through which the spikes do not penetrate.

U.S. Pat. No. 4,118,034 discloses a golfer's stance block. This device is an external wedge-shaped member which attaches to the sole of a golf shoe, during training sessions, and alters the elevation of the side of the user's foot.

U.S. Pat. No. 4,685,227 discloses golf shoes which elevate the outer side of both feet of the user above the inner sides.

U.S. Pat. No. 4,704,809 discloses a golf shoe which elevates the outer side of a user's foot above the inner side.

All of the devices recited above intentionally elevate a portion of one or both heels of a user's foot. Additionally. additionally, none of those devices elevates the outer forward portion of the user's foot only. The claimed invention, on the other hand, elevates only the outer forward portion of only one foot of the user without providing any adjustment to the position of the user's heel. Such elevation of the outer forward portion of one foot only, allows the user to achieve the above recited two factors which are important for the effective swing of an object. This is an entirely different concept from that disclosed in the U.S. Patents recited above.

SUMMARY OF INVENTION

Apparatus is provided for improving the swing of an object by a person which includes foot elevation apparatus for elevating the outer forward portion of a foot of the person above the remaining portion of the foot.

Also provided is apparatus for improving the swing of a gold club by a person which includes foot elevation apparatus adapted to be positioned in contact with a shoe of a person for elevating the outer forward portion of the foot of the person above the remaining portion of the foot.

Additionally provided is apparatus for improving the golf club swing of a person which includes spike apparatus attached to the exterior of a shoe of the person for elevating the outer forward portion of the foot of the person above the remaining portion of the foot.

Further provided is apparatus for improving the golf club swing of a person which includes a member which is adapted to be inserted inside a shoe of and underlie a foot of the person and which has a perimeter contour which approximates the perimeter contour of a foot of the person with said member having a varying cross-sectional thickness to elevate the outer forward portion of the foot of the person.

BRIEF DESCRIPTION OF THE DRAWINGS

The following description of the preferred embodiments of the present invention may be better understood if reference is made to the accompanying figures in which:

FIG. 6 is a front view, in section, of a shoe employing the invention of FIG. 4;

FIG. 7 is a bottom view of a shoe employing a third embodiment of the present invention;

FIG. 8 is a left side view of a shoe employing the invention of FIG. 7; and

FIG. 9 is a front view of a shoe, in section, employing the invention of FIG. 7.

DESCRIPTION OF THE PREFERRED EMBODIMENTS

For purposes of illustration only, the following discussion is based on a person who is right handed and, thus, swings an object from right to left, although the principles are equally applicable to left-handed persons also.

Figure 1:
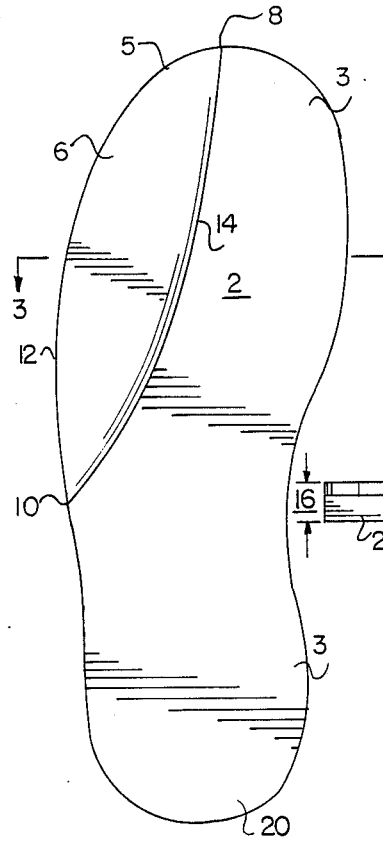
FIG. 1 is a bottom view of a first embodiment of the present invention.
Figure 2:
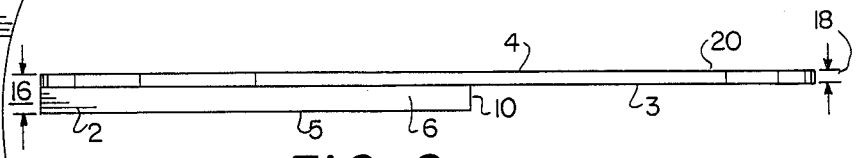
FIG. 2 is a left side view of the apparatus of FIG. 1.
Figure 3:
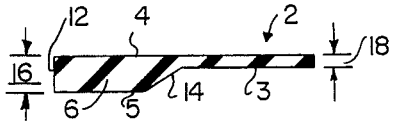
FIG. 3 is a front view, in section, of the apparatus of FIG. 1.

FIGS. 1 through 3 show foot positioner 2. The perimeter of foot positioner 2 is shaped, generally, to follow the contour of the interior of a shoe and is conveniently sized according to the size of the shoe where it will be employed. FIG. 1 shows a bottom view of foot positioner 2 which is designed to be inserted into a right shoe of a person with bottom surfaces 3 and 5 in contact with the inside bottom, or sole, of the shoe. Top surface 4, on foot positioner 2, is, preferably relatively flat along its entire surface. Foot positioner 2 includes elevating portion 6 which extends, generally, from front portion 8, which is near the toe portion of a typical shoe, to, generally, mid-portion 10, which is located, approximately, half way along the longitudinal extent of foot positioner 2.

Elevating portion 6 extends from right side 12 to, approximately the center of foot positioner 2 along contour 14. The exact shape and position of contour 14, with respect to right side 12, may be, somewhat, varied without reducing the functional capabilities of foot positioner 2. The thickness, 16, of raised portion 6 is, preferably, one-half inch. Additionally, thickness 18 is, preferably, one-eighth inch.

Foot positioner 2 is, preferably, constructed of a slightly compressible material, such as rubber or vinyl, to allow for comfort while still preventing substantial compression of elevating portion 6 under the weight of the person using it. Although foot positioner 2 may be constructed of a totally non-compressible substances, such as steel, such material is not, generally, desirable since a totally unyielding material would be uncomfortable to the person using it.

An important aspect of the present invention is that elevating portion 6 is of such a shape and thickness to raise only the outer, forward portion of a person's right foot without altering the position of the right heel. The same results may be achieved by employing the embodiment of the invention shown in FIGS. 4 through 6 or the embodiment of the invention shown in FIGS. 7 through 9.

Figure 4:
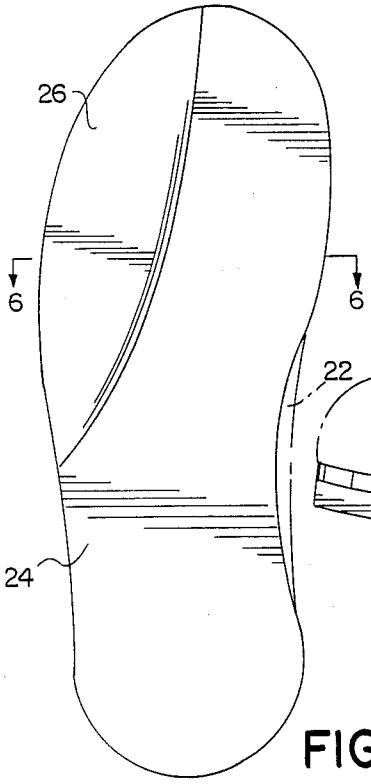
FIG. 4 is a bottom view of a shoe employing a second embodiment of the present invention.
Figure 5:
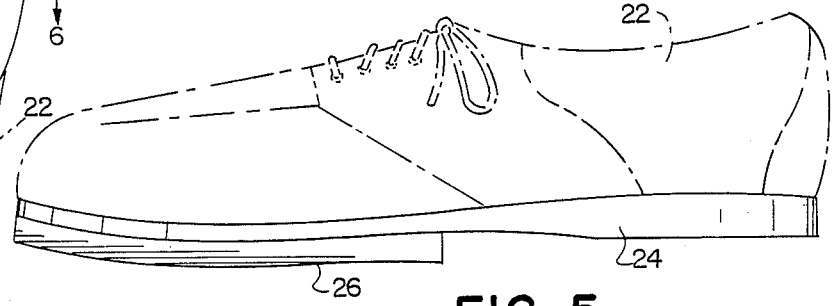
FIG. 5 is a side view of a shoe employing the invention of FIG. 4.

In FIGS. 4 through 6, shoe 22 includes sole 24. Sole 24 includes elevating portion 26 which may form an integral part of sole 24 or, as shown in FIG. 6, may be a separate attachment to sole 24. Elevating portion 26 is designed to underlie, generally, the same outer forward portion only of the user's right foot causing the outer forward portion of the user's right foot to be elevated above the remainder of the user's foot in a manner similar to the embodiment of FIGS. 1 through 3. This embodiment of the invention, likewise, does alter the position of the heel of the right foot.

FIGS. 7 through 9 show a third embodiment of the present invention. Shoe 28 includes sole 30. Attached to sole 30, in a manner well known to those of ordinary skill in the art, are a plurality of spikes 32 and 34. Spikes 32 are shorter than spikes 34. The relative lengths of spikes 32 and 34, along with their relative positioning on sole 30, as shown in FIGS. 7 through 9, elevates the outer forward portion only, of the right foot of the person wearing shoe 28 above the remainder of the foot in a manner similar to the embodiment of FIGS. 1 through 3 and the embodiment of FIGS. 4 through 6. Additionally, the remaining position of the heel of the user's foot is not altered.

It is preferable, although not mandatory, that the position of only the right foot be altered as described above with no such adjustment being made to the left foot. That is because the force applied to the upper body of the person swinging an instrument such as a golf club or ball bat is applied, generally, by the person's right leg. Therefore, minimal benefit is derived by adjusting the position of the user's left foot. In use, therefore, the right shoe of the user is adapted to include either the embodiment of FIGS. 1 through 3, the embodiment of FIGS. 4 through 6 or the embodiment of FIGS. 7 through 9. Alternatively, any two or those embodiments or all three of the embodiments may be combined together to elevate the outer forward portion only, of the user's right foot without comprising effectiveness.

It may be appreciated that, while the above recited description of the preferred embodiments is based on the invention being employed by a right-handed person, the apparatus of the present invention may be easily modified to accommodate a left-handed user who swings a golf club, ball bat or the like from left to right. For such a left-handed user, preferably, the left shoe only would be modified to elevate the outer, or left, forward portion of the user's left shoe thereby elevating the outer forward portion of the user's left foot only, above the remainder of the foot.

It may be appreciated, therefore, the present invention is useful and practical in improving the swing of an instrument such as a golf club, ball bat, ax, as well as other devices. In the case of an instrument, such as a golf club or ball bat which is designed to drive some type of ball, the apparatus of the present invention helps the user to drive the ball a greater than normal distance. Also, the apparatus of the present invention is useful when swinging an instrument, such as an ax, since it allows the user to apply more force per swing to the instrument.

Whereas particular embodiments of the invention have been described above for purposes of illustration, it will be evident to those skilled in the art that numerous variations of the details may be made without departing from the invention as defined in the appended claims.

What is claimed is:

1. Apparatus for improving the golf club swing of a person comprising a member which is adapted to be removably inserted inside a shoe of and underlie the foot of the person which is opposite the direction of the swing of the golf club and which has a perimeter contour which is generally the same shape as the perimeter contour of the foot of the person with only an outer forward portion of said member having an increased cross-sectional thickness to elevate only the outer forward portion of the foot of the person with said member being constructed of a slightly compressible material to limit the amount of compression of said member when said member is elevating the outer forward portion of the foot of the person.

2. The apparatus of claim 1 wherein said slightly compressible material is selected from the group consisting essentially of rubber and vinyl.

3. The apparatus of claim 2 wherein said perimeter contour of said member is generally the same shape as the perimeter contour of the right foot of a person who swings a golf club from right to left.

4. The apparatus of claim 2 wherein said perimeter contour of said member is generally the same shape as the perimeter contour of the left foot of a person who swings a golf club from left to right.

5. The apparatus of claim 3 wherein said member elevates the foot of the person about five-eighths of one inch.

6. The apparatus of claim 4 wherein said member elevates the foot of the person about five-eighths of one inch.

* * * * *